United States Patent [19]

Tsutsui et al.

[11] 4,169,916

[45] Oct. 2, 1979

[54] STEEL SHEETS AND METHOD OF TREATING STEEL SHEETS

[75] Inventors: Nobuyuki Tsutsui, Kudamatsu; Hitoshi Omura, Hofu; Takashi Mizobe, Kudamatsu; Katsumi Kanda, Kudamatsu; Terunori Fujimoto, Tokyo, all of Japan

[73] Assignee: Toyo Kohan Co., Ltd., Japan

[21] Appl. No.: 855,342

[22] Filed: Nov. 28, 1977

Related U.S. Application Data

[63] Continuation of Ser. No. 701,605, Jul. 1, 1976, abandoned.

[30] Foreign Application Priority Data

Dec. 22, 1975[JP] Japan ..... 50-151993

[51] Int. Cl.[2] ..... B32B 9/04

[52] U.S. Cl. ..... 428/447; 427/372 B; 427/387; 427/388 C; 428/450; 428/451; 428/467; 428/469

[58] Field of Search ..... 427/388 R, 387, 372 B; 428/450, 471, 451, 467, 469, 447

[56] References Cited

U.S. PATENT DOCUMENTS 2,699,407 1/1955 Martens et al. ..... 428/450 X

OTHER PUBLICATIONS

Baker et al., *Polar Type Rust Inhibitors*, pp. 137-144.

*Primary Examiner*—Bernard D. Pianalto

*Attorney, Agent, or Firm*—Wenderoth, Lind & Ponack

[57] ABSTRACT

A method of treating steel sheets which have good corrosion resistance after forming, which comprises coating a steel sheet with a solution which contains:

(a) water-soluble or water-dispersible lithium silicate at a concentration of 2 to 250 g/l, which lithium silicate is a mixture of silicic acid or silicate and lithium salt in a molar ratio of 20:1 to 1:1.

(b) at least one water-soluble or water-dispersible saturated or unsaturated fatty acid compound, higher alcohol wax, polyethylene type resin, fluorine type resin or silicone type resin at a concentration of 1 to 250 g/l.

13 Claims, No Drawings

STEEL SHEETS AND METHOD OF TREATING STEEL SHEETS

This is a continuation of application Ser. No. 701,605, filed July 1, 1976 and now abandoned.

BRIEF DESCRIPTION OF THE INVENTION

The present invention relates to a method of treating steel sheets, whereby the steel sheets are coated with the solution containing at least one water-soluble or water-dispersible lithium silicate which is a mixture of silicic acid or silicate and lithium salt, e.g. lithium hydroxide, said solution further containing a water soluble or water dispersible saturated or unsaturated fatty acid compound, higher alcohol wax, polyethylene resin, fluorine resin or silicate resin. Furthermore, the solution can contain at least one water soluble chromic acid, chromate, dichromate, phosphoric acid or phosphate. The coated sheets are then dried.

It is an object of the present invention to produce steel sheets for forming which have a good corrosion resistance after forming by uniformly coating with the above solution.

BACKGROUND OF THE INVENTION

Generally, when steel sheets are formed, liquid wax, lubricating oils, organic high polymers etc. are coated on the steel before forming in order to prevent rupturing and scuffing during the forming. In the above-mentioned methods, complicated processes such as a cleaning and drying are required after forming in order to remove lubricants and to make matters worse, the corrosion resistance of the part which is subjected to forming decreases considerably; however, no better method is presently known.

On the other hand, plating of steel sheets is sometimes used to prevent the decrease of corrosion resistance after forming. For instance, galvanized steel sheet and electrogalvanized sheet are widely used because the zinc plating on sheets gives a remarkable corrosion resistance to the base steel, however, zinc-plated steel sheets are not satisfactory in formability, for some cracks occur in drawing ratio 2 without coating of lubricating oil. Also in a lower drawing ratio than the 2.0, the plated layer in the part to be formed is destroyed to a great extent and consequently corrosion resistance deteriorates considerably to almost the same level of the base steel sheets without the plated layer. However, the occurence of cracks during drawing can be somewhat reduced by coating the electrogalvanized sheets with machine oil or press oil during drawing. In this case, an oil coating process and a cleaning process are required and these processes contribute to low productivity. Moreover, the corrosion resistance at the drawn part deteriorates noticeably.

These methods are referred in published Japanese patent application Nos. Sho 45-5130 and 49-24789, which applications are the starting point of the present invention.

Published Japanese patent application No. Sho 45-5130 discloses a method of coating steel sheets with solution which mainly consists of lithium silicate in order to increase corrosion resistance, however, this method provides no improved effects on formability of the sheet, and in fact, the sheet by this method requires lubricating oil during deep drawing because of its poor formability.

Published Japanese patent application No. Sho 49-24789, discloses a method to improve formability of metal plates and to prevent occurrance of defects during forming, by first coating a water glass film on a steel sheet and then coating with a solution of solid wax dissolved in an organic solvent, then followed by drying.

This method of making a dual layer by two coatings is very complicated and the corrosion resistance after forming is merely temporary, i.e. it only remains until the next surface treating process, because it is designed so that the coated films can be easily removed by hot water and not be permanent.

On the contrary, the present invention avoids these defects arising from forming of steel sheets.

The application of the present invention omits the processes of oil coating and cleaning, and forms a strong coating film which contains lithium compound, so that a steel sheet with the film of the present invention can be formed without reducing the corrosion resistance after forming. Moreover, a point of advantage of the present invention is the possibility of handling the steel sheet without contaminating the surface with the dirt, i.e. fingerprints because the film formed by the method of the present invention is solid and difficult to dissolve. Further, the solution used in the present invention is water-based, and has an advantage in safety and sanitation.

DETAILED DESCRIPTION OF THE INVENTION

The present method involves coating a steel sheet with a solution which contains at least one or more water soluble or water dispersible lithium silicates prepared from silicic acid or a silicate and a lithium salt, e.g. the hydroxide and at least one or more water soluble or water dispersible saturated or unsaturated fatty acid compounds, higher alcohol waxes, polyethylene type resins, fluorine type resins, silicone type resins, or and if desired, one or more of water soluble chromic acid, chromate, dichromate, phosphoric acid and phosphate, onto the steel sheets. Then the coated sheet is dried immediately.

It is preferred that lithium silicate used in the present invention is water soluble or dispersible and is prepared from mixture of silicic acid or silicate and lithium salt in a molar ratio of 20:1 to 1:1. Lithium ion itself has the characteristic role of promoting the solidification and insolubility of treated film, and contributes to the formation of film with superior corrosion resistance. Therefore, lithium silicate which is prepared using lithium hydroxide at a lower ratio than the above-mentioned, exhibits a tendency to decrease corrosion resistance and retard hardening of the film with solidification. Conversly, the treating solution has a tendency to be gelled at a higher ratio than the above mentioned.

Lithium silicate may be prepared according to the following; sodium or potassium silicate, or silicate sol which is commercially available as silicic acid or silicate, and lithium hydroxide are respectively weighed and mixed together in the above-mentioned ratio. Further, commercially available water-soluble or water-dispersible lithium silicate, i.e. which is already mixed together may be employed, e.g. Snowtex of Nissan Chemical Industries, Ltd. A concentration of lithium silicate in the range of from 2 to 250 g/l is suitable for the treatment solution of the present invention. A film formed by the solution with the above-mentioned concentration gives superior corrosion resistance and prevents adherence of dirt, e.g. fingerprints on the surface in handling, press-forming etc.

At a concentration of less than 2 g/l, the effects mentioned above cannot be expected. At a concentration of more than 250 g/l, the improvement in corrosion resistance is not in proportion to the increasing concentration, and on the contrary, the treated film exhibits a remarkably poor effect on the formability of a steel sheet.

Next, the water-soluble or water-dispersible lubricant is added to the solution of lithium silicate in order to improve the formability of the steel sheet.

These lubricants may include the following agents; saturated fatty acid compounds, e.g. esters or salts such as stearates, palmitates and myristates; unsaturated fatty acid compounds, e.g. esters or salts such as oleates and linolates; higher alcohol type waxes such as melissyl alcohol, tetracosanol and stearyl alcohol; polyethylene type resins such as various kinds of polyethylene resin with 5,000–40,000 molecular weight; fluorine type resins such as tetrafluoroethylene, chlorotrifluoroethylene and fluorovinylidene resins; silicone type resins such as dimethylpolysiloxane, methylhydrogen polysiloxane and silicone alkyd varnish. The treatment solution comprises one or more of these agents.

The concentration in the range of 1 to 250 g/l is suitable for improving the formability. The concentration of less than 1 g/l gives little effect on improvement of the formability, conversely the concentration of more than 250 g/l imparts a remarkably bad influence on the corrosion resistance, makes it easy to contaminate the surface with the dirt, i.e. fingerprints in handling, press-forming, and gives the finished surface sheet a poor appearance.

For the purpose of further improving corrosion resistance, at least one agent selected from soluble chromic acid, chromate, dichromate, phosphoric acid and phosphate are added to the above-mentioned solution. Suitable compounds include chromates and dichromates containing hexavalent chromium such as chromic acid, sodium chromate, ammonium chromate, sodium bichromate and ammonium bichromate. The phosphates include monosodium (hydrogen) phosphate, disodium (hydrogen) phosphate, ammonium phosphate, potassium phosphate etc.

A concentration in the range of 1 to 100 g/l is suitable for achieving the increase of the corrosion resistance. A concentration of less than 1 g/l imparts no improvement in the corrosion resistance, and a concentration of more than 100 g/l is unfavorable because further improvement is not realized, the cost is high and the treatment solution has a tendency to be unstable and susceptible to gellation.

Water soluble organic high polymers, or surface active agents including non-ionic, anionic and cationic types may be also added to the treatment solution in order to disperse the lubricant uniformly in the treatment solution, or to improve wetting of the steel sheet with the treatment solution.

A temperature of 25° C. to 70° C. is suitable for treating with the solution. A temperature of less than 20° C. may be not necessarily unsuitable, but it has a disadvantage in requiring a longer time to dry. On the other hand, at a temperature of more than 70° C., it is difficult to keep the concentration of bath constant by reason of a higher vaporation, which makes the bath unstable and susceptible to gellation.

A steel sheet may be coated with the solution by dipping, spraying as well as roller-coating, and it is dryed after coating. Although drying at room temperature is suitable for application of the present invention, it is desirable to dry by force rather than naturally at room temperature, thereby avoiding long drying times. Especially when polyethylene, fluorine or silicone type resins are used as lubricants, it is desirable to dry by force at a temperature of 80° C. to 200° C. The thickness of a treated film, which is mainly controlled by the concentration of lithium silicate and addition agent, becomes thicker in proportion to the increasing concentration.

The present invention is applicable to an electrolytic zinc, chromium, tin, copper, nickel, aluminum and other metal plated steel sheets as well as to cold rolled steel sheet. Also the present invention is applicable to those steel sheets with a post-treatment such as with chromate, phosphate and so forth.

The detailed effects of the present invention will now be explained taking into account the following practical, non-limitative examples.

EXAMPLE 1

A low carbon steel sheet of 0.5 mm thickness, after annealing and temper rolling, was dipped into the following solution, and was dried with a hair dryer at about 70° C. to form a film.

| Treatment Solution | |
|---|---|
| Lithium silicate which consists of a mixture of silicic acid and lithium hydroxide in a molar ratio of 8 : 1 | 150 g/l |
| Sodium stearate | 7 g/l |
| Sodium chromate | 50 g/l |
| Epan-785 (non-ionic surface active agent produced by Dai-Ichi Kogyo Seiyaku Co., Ltd.) | 3 g/l |
| Temperature of the solution | 40° C. |

The sheet, after treatment in the above solution was blanked to form a disk specimen 80 mm in diameter, was drawn deeply in a drawing ratio of 2 by means of a punch and die, and was evaluated for corrosion resistance of the deformed part. In case of the deep drawing, a steel sheet which was not treated with the above solution cannot be drawn free from rupture without #620 machine oil as lubricant, while the sheet treated in the solution of the present invention can be drawn successfully without any lubricants. Subsequently the salt spray test provided by JIS Z 2371 was applied to these two drawn parts. The drawn part without the treating in this solution was covered with red rust after 10 minutes, while the drawn part treated in the solution of the present invention did not show any red rust even after 2 hours.

It was also found from the humidity exposure test at a temperature of 50° C., and relative humidity of 95%, that the drawn part without treating in this solution showed rust after an hour; on the contrary, the drawn part with treating in this solution did not show any rust after 24 hours.

EXAMPLE 2

A low carbon steel sheet of 0.5 mm thickness was cleaned and pickled for pre-treatment by a conventional method. The sheet was then electrogalvanized as described below and was then treated as follows:

(1) dipping in the solution described below, (2) squeezing by a wringer roll, immediately followed by force drying at 150° C. for 5 seconds.

On the other hand, an electrogalvanized sheet, which was not processed according to the present invention was treated with a conventional chromate solution so as to be coated with an 0.5 mg/dm$^2$ chromium film on the surface.

(1) The conditions for electrogalvanizing:

| | |
|---|---|
| Zinc sulfate | 250 g/l |
| Sodium sulfate | 30 g/l |
| Aluminum sulfate | 20 g/l |
| Temperature of the electrolyte | 40° C. |
| Current Density | 20 A/dm$^2$ |
| Plating time | 20 seconds |

(2) Composition of the treatment solution:

| | |
|---|---|
| Lithium silicate which consists of a mixture of silicic acid and lithium hydroxide in a molar ratio of 8 : 1 | 230 g/l |
| Tetracosanol (Commercial name: SAIVINOR DP-12B, produced by Saiden Chemical Ind. Co., Ltd.) | 150 g/l |
| Sodium dichromate | 10 g/l |
| Temperature of the solution | 45° C. |

Both the electrogalvanized sheet subjected to the present invention and the electrogalvanized sheet with the conventional chromate treatment were blanked to form a disk specimen 120 mm in diameter, and were pressed to a cylindrical shell by means of a punch 69 mm in diameter and die. The sheet with only conventional chromate treatment was ruptured during pressing without the use of lubricating oil. Conversely the sheet which was treated in the solution was not ruptured, and showed little scuffing on the surface even without lubricating oil.

The salt spray test as described in Example 1 was applied to the cylindrical shell wall in order to evaluate its corrosion resistance. Before the test, the test piece from the cylindrical shell with the chromate treatment was cleaned with trichloroethylene vapor. The rust on the test piece was observed after 24 hours, while rust on test piece from the cylindrical shell wall which had been treated in this solution was observed only after 70 hours.

In the humidity exposure test as described in Example 1, rust was observed on the side wall of the former after 40 hours, while no rust was found in the latter after 300 hours.

EXAMPLE 3

A low carbon steel sheet, 0.5 mm in thickness, was electrogalvanized by the electrogalvanizing treatment described in Example 2, to give a coating of 12 g/m$^2$. Subsequently it was dipped in the following solution, and was dried by force at 120° C.

Treatment Solution

| | |
|---|---|
| Lithium silicate which consists of a mixture of sodium silicate and lithium hydroxide in molar ratio of 20 : 1 | 50 g/l |
| Polyethylene (molecular weight: about 12,000) | 200 g/l |
| Sodium phosphate | 5 g/l |
| Temperature of the solution | 40° C. |

The electrogalvanized sheets which were treated in the above solution were blanked to form a disk specimen 120 mm in diameter and were pressed to a cylindrical shell by means of a punch, 69 mm in diameter and die in the same way as described in Example 2. As a result of the pressing, it was proved that the sheet with the film of the present invention showed no rupture and little scuffing on the side wall of cylindrical shell, even without lubricating oil.

The sheet cut from the side wall of the cylindrical shell was evaluated by the salt spray test and the humidity exposure test as described in Example 1. The results showed that no rust was observed after 50 hours in the salt spray test and no rust after 200 hours in the humidity exposure test.

What we claim is:

1. A method of treating steel sheets which have good corrosion resistance after forming, which comprises coating a steel sheet with an effective amount to inhibit corrosion, of a solution which consists essentially of water and:

(a) water-soluble or water-dispersible lithium silicate at a concentration of 2 to 250 g/l, which lithium silicate is a mixture of silicic acid or silicate and lithium salt in a molar ratio of 20:1 to 1:1, (b) at least one water-soluble or water-dispersible saturated or unsaturated fatty acid compound, higher alcohol wax, polyethylene type resin, or silicone type resin at a concentration of 1 to 250 g/l, (c) at least one water-soluble phosphate or phosphoric acid at a concentration of 1 to 100 g/l.

2. A method of treating steel sheets according to claim 1 wherein said lithium salt is lithium hydroxide.

3. A method according to claim 1 wherein there is employed phosphate selected from the group consisting of monosodium hydrogen phosphate, disodium hydrogen phosphate, ammonium phosphate or potassium phosphate.

4. A method of treating metal sheets according to claim 1 wherein the steel is plated with a metal selected from the group consisting of zinc, chromium, tin, copper, nickel or aluminum.

5. A method according to claim 1 wherein the sheet is a cold-rolled steel sheet.

6. A method according to claim 1 wherein silicate is selected from the group consisting of potasium or sodium silicate.

7. A method according to claim 1 wherein the fatty acid compound is employed and said compound is selected from the group consisting of stearates, palmitates, myristates, oleates and linolates.

8. A method according to claim 1 wherein an alcohol-type wax is employed and said wax is selected from the group consisting of melissyl alchol, tetracosanol and stearyl alcohol.

9. A method according to claim 1 wherein a polyethylene type resin is employed and said resin has a molecular weight of 5,000 to 40,000.

10. A method according to claim 1 wherein a silicone-type resin is employed and said resin is selected from the group consisting of dimethylpolysiloxanes, methylhydrogen polysiloxanes and silicone alkyd varnish.

11. A method according to claim 1 wherein the steel sheet is dried immediately after coating.

12. The steel sheet produced by the process of claim 11.

13. A method according to claim 11 wherein the treated steel sheet is forced dried at a temperature of from 80° C. to 200° C.

* * * * *